US007580019B2

(12) United States Patent
Hong et al.

(10) Patent No.: US 7,580,019 B2
(45) Date of Patent: Aug. 25, 2009

(54) METHOD AND APPARATUS FOR DRIVING LIQUID CRYSTAL DISPLAY DEVICE

(75) Inventors: Hee Jung Hong, Seoul (KR); Kyung Joon Kwon, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 839 days.

(21) Appl. No.: 11/150,542

(22) Filed: Jun. 10, 2005

(65) Prior Publication Data

US 2006/0139284 A1 Jun. 29, 2006

(30) Foreign Application Priority Data

Nov. 25, 2004 (KR) ..... 10-2004-0097696
Dec. 29, 2004 (KR) ..... 10-2004-0115730

(51) Int. Cl.
*G09G 3/36* (2006.01)
*G09G 5/00* (2006.01)
*G06F 3/038* (2006.01)

(52) U.S. Cl. ..... 345/87; 345/89; 345/98; 345/99; 345/204

(58) Field of Classification Search ..... 345/87, 345/89, 98, 99, 204
See application file for complete search history.

(56) References Cited

U.S. PATENT DOCUMENTS 7,142,183 B2 * 11/2006 Lee ..... 345/87
7,202,882 B2 * 4/2007 Morita ..... 345/698
7,450,096 B2 * 11/2008 Kwon ..... 345/87
2003/0080983 A1 * 5/2003 Someya et al. ..... 345/690
2004/0100433 A1 * 5/2004 Ham ..... 345/89
2004/0263495 A1 * 12/2004 Sugino et al. ..... 345/204
2005/0140686 A1 * 6/2005 Kwon ..... 345/560
2005/0237316 A1 * 10/2005 Huang et al. ..... 345/204

FOREIGN PATENT DOCUMENTS

JP 2000-321571 11/2000

OTHER PUBLICATIONS

Office Action issued in corresponding Japanese Patent Application No. 2005-153435; mailed May 7, 2008.

* cited by examiner

*Primary Examiner*—Sumati Lefkowitz
*Assistant Examiner*—Alexander S. Beck
(74) *Attorney, Agent, or Firm*—Brinks Hofer Gilson & Lione

(57) ABSTRACT

A driving method and apparatus of a liquid crystal display device is described. Data from a current frame is compressed and delayed by a frame memory. Compressed data of the current frame and the compressed data of a previous frame from the frame memory are restored. The restored data of the previous frame is compared with the restored data of the current frame to determine a modulated portion for the current frame in accordance with the comparison result. The current frame data is modulated by adding the modulated portion to the current frame data. Only a single frame memory is disposed within the driving apparatus.

6 Claims, 8 Drawing Sheets

42
SRGB In
k
60
61A
FIRST LINE MEMORY
ORGB(Fn)
k
ERGB(Fn)
k
62
LINE COMBINER
2k
63
COMPRESSOR
j
64
FRAME MEMORY
j
61C
THIRD LINE MEMORY
RGB(Fn−1)
65B
RESTORER
65A
RESTORER
ORGB(Fn)
k
ERGB(Fn)
k
ORGB(Fn−1)
k
61B
SECOND LINE MEMORY
ERGB(Fn−1)
k
61D
FOURTH LINE MEMORY
66A
CH
RGB(Fn)
k
66B
CH
RGB(Fn−1)
k
67
LOOKUP TABLE
68
69
MRGB Out
61E
FIFTH LINE MEMORY

FIG.8

| | | | |
|---|---|---|---|
| YUV | YUV | YUV | YUV |
| YUV | YUV | YUV | YUV |

FIG.9

| | | | |
|---|---|---|---|
| A | A | B | A |
| A | B | B | B |

FIG.10

| | | | |
|---|---|---|---|
| 1 | 1 | 0 | 1 |
| 1 | 0 | 0 | 0 |

METHOD AND APPARATUS FOR DRIVING LIQUID CRYSTAL DISPLAY DEVICE

This application claims the benefit of the Korean Patent Application No. P2004-115730 filed on Dec. 29, 2004, which is hereby incorporated by reference.

BACKGROUND OF THE INVENTION

1. Field of the Invention

The present invention relates to a liquid crystal display device, and more particularly to a method and apparatus of driving a liquid crystal display that is adaptive for reducing the number of frame memories.

2. Description of the Related Art

A liquid crystal display device controls the light transmissivity of liquid crystal cells in accordance with a video signal, thereby displaying a picture.

In the liquid crystal display device, an active matrix liquid crystal display device in which a switching device is formed at each liquid crystal cell better displays a motion picture because active control of the switching device is possible. A thin film transistor (hereinafter, referred to as "TFT") is mainly used as the switching device in the active matrix liquid crystal display.

However, the response speed of liquid crystal display, as shown in mathematical formulas 1 and 2, and dependent on the unique viscosity and elasticity of liquid crystal.

$$\tau_r \propto \frac{\gamma d^2}{\Delta\varepsilon|V_a^2 - V_F^2|} \quad \text{[MATHEMATICAL FORMULA 1]}$$

Herein, $\tau_r$ represents the rise time when a voltage is applied to liquid crystal, Va represents the applied voltage, $V_F$ represents the Freederick Transition Voltage where a liquid crystal molecule starts to tilt, d represents the cell gap of the liquid crystal cell, and γ (gamma) represents the rotational viscosity of the liquid crystal molecule.

$$\tau_f \propto \frac{\gamma d^2}{K} \quad \text{[MATHEMATICAL FORMULA 2]}$$

Herein, $\tau_f$ represents the fall time when the liquid crystal is restored to its original location by its elastic restitutive force after the voltage applied to the liquid crystal is turned off, and K represents the unique elastic modulus of liquid crystal.

The response speed of a twisted nematic TN mode liquid crystal is generally used may differ in accordance with the physical properties and cell gap of the liquid crystal material, but conventionally, the rise time is 20~80 ms and the fall time is 20~30 ms. In this case, the response speed of the liquid crystal is longer than one frame period (NTSC: 16.67 ms).

Because of this, it progresses to the next frame before the voltage charged in the liquid crystal cell reaches a desired voltage, as shown in FIG. 1, thus motion blurring is generated in which the screen gets blurred when playing the motion picture.

Referring to FIG. 1, a liquid crystal display device of the prior art does not express a desired color and brightness because the display brightness BL corresponding thereto does not reach the desired brightness when the data VD is changed from one level to another level. As a result, the liquid crystal display device is blurry when showing a motion picture, and its picture quality drops due to the deterioration of the contrast ratio.

In order to solve the slow response speed of the liquid crystal display device, U.S. Pat. No. 5,495,265 or PCT International Publication No. WO99/05567 has suggested a method of modulating data in accordance with the existence or absence of the change of the data using a look-up table, hereinafter referred to as a "high-speed driving method". The high speed driving method modulates the data using the principle shown in FIG. 2.

Referring to FIG. 2, the high speed driving method modulates input data VD into a pre-set modulated data MVD, and the modulated data MVD is applied to the liquid crystal cell to get the desired brightness MBL. The high speed driving method has a value of $|V_a^2 - V_F^2|$ in Mathematical Formula 1 on the basis of the existence or absence of a change of the data in order to get a desired brightness corresponding to the brightness value of the input data within one frame period. Accordingly, the liquid crystal display device using the high speed driving method compensates for the slow response time of liquid crystal by modulating the data value to ease blurring of the motion in a motion picture.

In other words, the high speed driving method modulates the data of the current frame to a pre-set modulated data if there is any change between the data when the data are compared between the previous frame and the current frame. A high speed driving apparatus in which the high speed driving method is realized is shown in FIG. 3.

Referring to FIG. 3, the high speed driving apparatus includes first and second frame memories 33A, 33B to store the data from a data bus 32, and a lookup table 34 to modulate the data.

The first and second frame memories 33A, 33B alternately store the data of the frame in accordance with a pixel clock, alternately output the stored data, and supply the previous frame data, i.e., $(n-1)^{th}$ frame data (Fn−1), to the lookup table 34.

The look-up table 34 selects a pre-set modulated data MRGB by having the $n^{th}$ frame data (Fn) and the $(n-1)^{th}$ frame data (Fn−1) from the first and second frame memory 33A, 33B as the address, thereby modulating the data. The lookup table 34 includes a read only memory ROM and a memory address control circuit.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |

TABLE 1-continued

| | | | | | | | | | | | | | | | | |
|---|---|---|---|---|---|---|---|---|---|---|---|---|---|---|---|---|
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

In the Table 1, the leftmost column represents the data of the previous frame Fn−1 and the uppermost row represents the data of the current frame Fn.

For the $n^{th}$ frame period, the nth frame data (Fn) is stored at the first frame memory and supplied to the lookup table 34 in accordance with the same pixel clock as shown by the solid lines. At the same time, the second frame memory 33B supplies the (n−1)th frame data (Fn−1) to the lookup table 34.

Differently from this, for the $(n+1)^{th}$ frame period, the current $(n+1)^{th}$ frame data (Fn+1) is stored at the second frame memory 33B and simultaneously supplied to the lookup table 34 in accordance with the same pixel clock as shown by the dotted lines. At the same time, for the $(n+1)^{th}$ frame period, the first frame memory 33B supplies the $n^{th}$ frame data (Fn) to the lookup table 34.

In this way, the high speed driving apparatus needs two frame memories 33A, 33B in order to alternately supply the previous frame data to the lookup table 34. However, frame memories are expensive. As the use of multiple frame memories increases the circuit cost, a method of reducing the number of frame memories and reducing the capacity is desirable.

SUMMARY OF THE INVENTION

By way of introduction only, a driving method of a display device according to an aspect of the present invention comprises: compressing current frame data; storing the compressed current frame data in a frame memory; restoring the compressed data of the current frame and compressed data of a previous frame from the frame memory; comparing the restored data of the previous frame with the current frame data and determining a modulated portion for the current frame in accordance with the comparison result; and modulating the current frame data by adding the modulated portion to the current frame data.

The driving method further comprises: delaying odd line data of the current frame data by one line period; and combining the delayed odd line data with un-delayed even line data and outputting the odd line data and the even line data at the same time.

In compressing the current frame data, compression is performed for the combined odd line data and even line data.

The driving method further comprises: delaying both odd and even line data of the current frame to produce line delayed current frame data and modulating the current frame data by adding the modulated portion to the line delayed current frame data.

In the driving method, determining the modulated portion comprises: comparing the restored data of the previous frame with the current frame data (which may be restored) to select pre-set modulated data in accordance with the comparison result; and extracting the modulated portion by subtracting the modulated data from the current frame data.

In the driving method, determining the modulated portion comprises: comparing the restored data of the previous frame with the current frame data (which may be restored) to select a pre-set modulated portion in accordance with the comparison result.

A driving apparatus of a display device according to another aspect of the present invention includes a compressor to compress current frame data; a frame memory to store the compressed current frame data; a restorer to restore the compressed data of the current frame and compressed data of a previous frame from the frame memory; a modulated portion determiner to compare the restored data of the previous frame with the current frame data (which may be restored) and to determine a modulated portion for the current frame in accordance with the comparison result; and a modulator to modulate the current frame data using the modulated portion.

The driving apparatus further comprises a first line memory to delay odd line data of the current frame data by one line period; and a combiner to combine the delayed odd line data with un-delayed even line data and to output the odd line data and the even line data at the same time.

In the driving apparatus, the restorer comprises: a first restorer to restore the compressed data of the current frame; and a second restorer to restore the compressed data of the previous frame from the frame memory.

The driving apparatus further comprises a second line memory to delay data from the first restorer; a first multiplexer to alternately output un-delayed data from the first restorer and delayed data from the second line memory; a third line memory to delay data from the frame memory and to supply the delayed data to the second restorer; a fourth line memory to delay data from the second restorer; and a second multiplexer to alternately output un-delayed data from the second restorer and delayed data from the fourth line memory.

In the driving apparatus, the modulated portion determiner comprises: a lookup table to compare the restored data of the previous frame with the current frame data (which may be restored) and to select pre-set modulated data in accordance with the comparison result; and a subtracter to extract the modulated portion by subtracting the modulated data from the current frame data.

The driving apparatus further includes a fifth line memory to delay un-compressed data of the current frame.

In the driving apparatus, the modulated portion determiner comprises: a lookup table to compare the restored data of the previous frame with the restored data of the current frame data and to select a pre-set modulated portion in accordance with the comparison result.

In the driving apparatus, the adder adds data from the fifth line memory with data from the lookup table.

In the driving apparatus, the restorer comprises a plurality of restorers. At least one of the restorers restores the compressed data of the current frame and at least one of the restorers restores the compressed data of the previous frame from the frame memory.

In the driving apparatus, the modulator comprises an adder that adds the modulated portion to the current frame data.

BRIEF DESCRIPTION OF THE DRAWINGS

The following detailed description of the embodiments of the present invention reference the accompanying drawings, in which:

FIG. 8 is a diagram representing an example of a 4×2 data block outputted from a YUV calculator of FIG. 7; and FIGS. 9 and 10 are diagrams explaining a compression principle of a compressor shown in FIG. 7.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 4 to 10.

Figure 1:
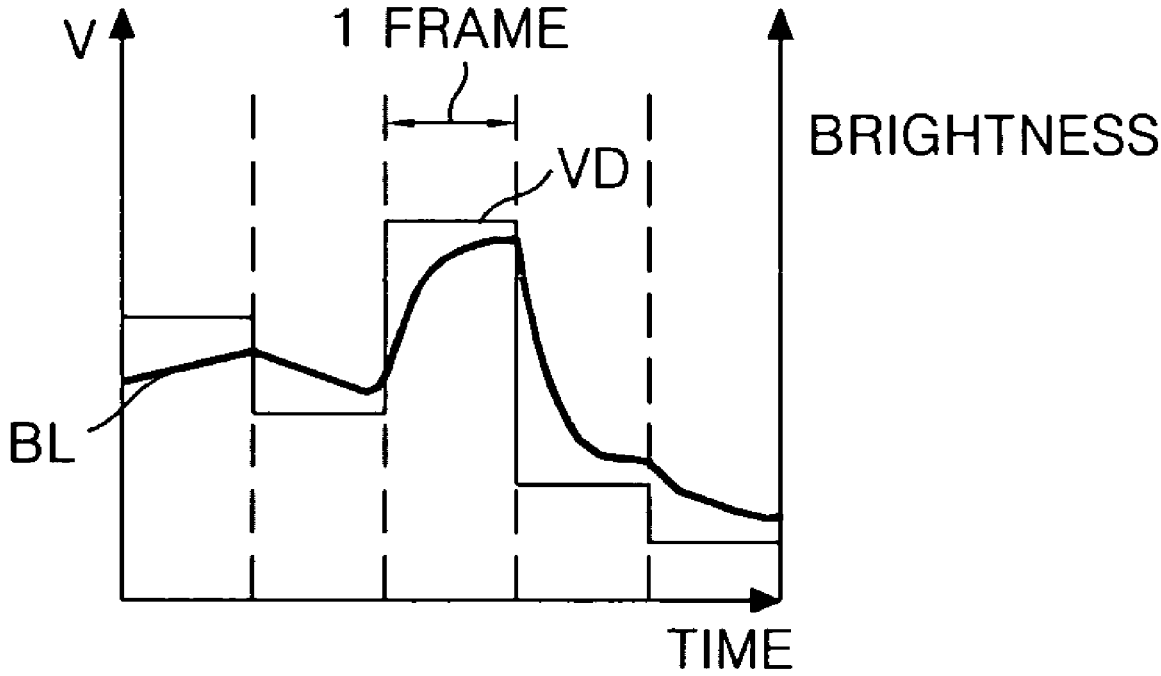
FIG. 1 RELATED ART
FIG. 1 is a waveform diagram representing a brightness change in accordance with data in a liquid crystal display device of the prior art.
Figure 2:
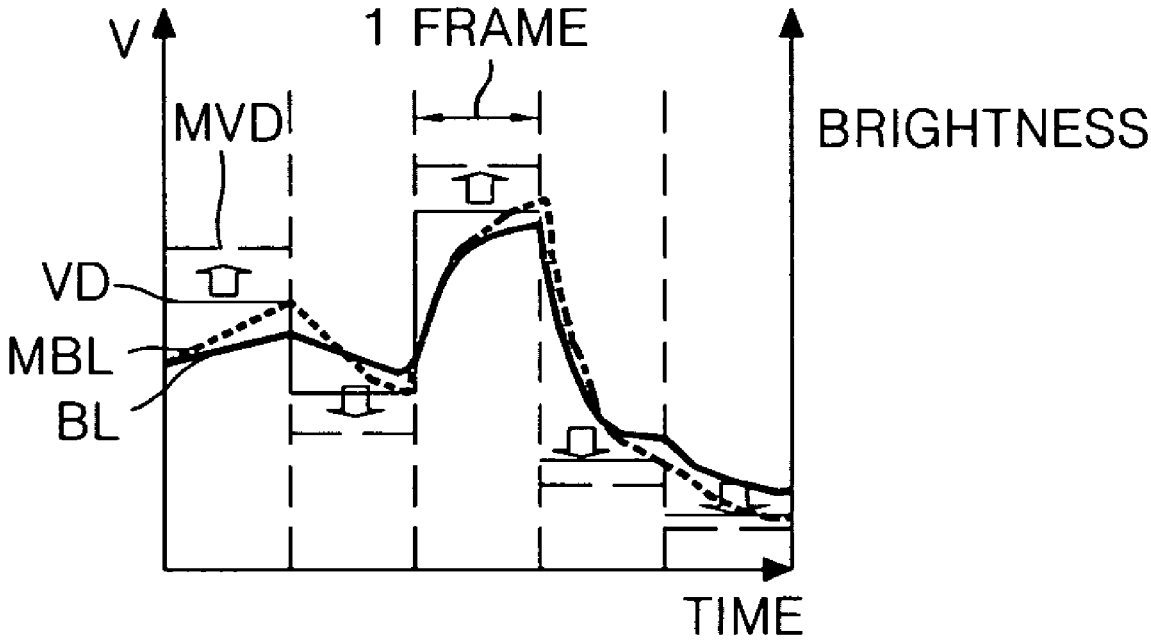
FIG. 2 RELATED ART
FIG. 2 is a waveform diagram representing an example of the brightness change in accordance with data modulation in a high speed driving method.
Figure 3:
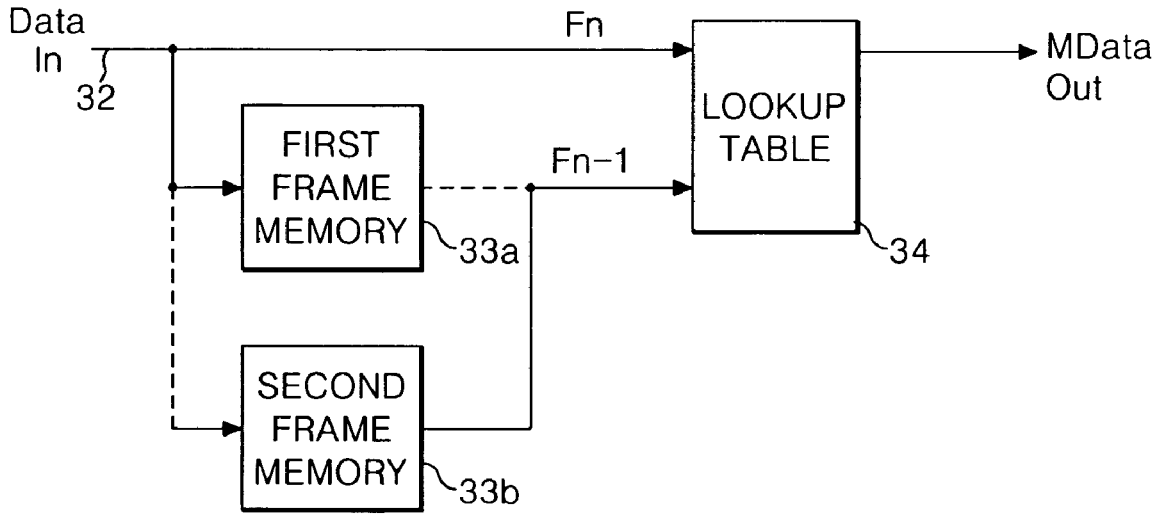
FIG. 3 RELATED ART
FIG. 3 is a diagram representing one example of the high speed driving method.
Figure 4:
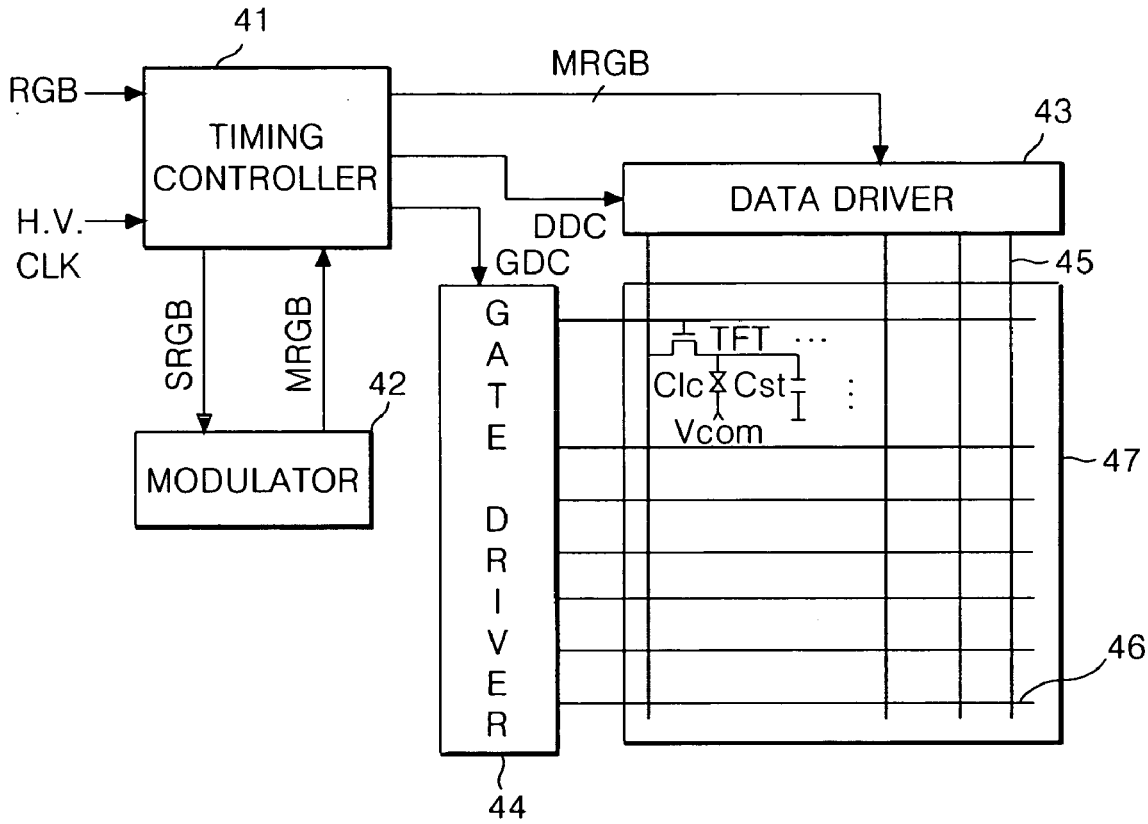
FIG. 4 is a diagram representing a liquid crystal display device according to an embodiment of the present invention.

Referring to FIG. 4, the liquid crystal display device according to the present invention includes a liquid crystal display panel 47 in which a thin film transistor TFT is formed to drive a liquid crystal cell Clc at each intersection of a data line 45 and a gate line 46; a data driver 43 to supply modulated data MRGB to the data line 45 of the liquid crystal display panel 47; a gate driver 44 to supply a scan pulse to the gate line 46 of the liquid crystal display panel 47; a modulator 42 to modulate source data, which has gone through compression and restoration processes, to a pre-set modulated data MRGB; and a timing controller 41 to control the data driver 43 and the gate driver 44 and to supply data RGB to the modulator 42.

The liquid crystal display panel 47 has liquid crystal injected between two glass substrates, and the data lines 45 and the gate lines 46 perpendicularly cross each other on the lower glass substrate. The TFT formed at the intersection of the data lines 45 and the gate lines 46 supplies the data from the data lines 45 to the liquid crystal cell Clc in response to a scan pulse from the gate line 46. For this, a gate electrode of the TFT is connected to the gate line 46 and a source electrode is connected to the data line 45. A drain electrode of the TFT is connected to a pixel electrode of the liquid crystal cell Clc. Further, a storage capacitor Cst is formed on a lower glass substrate of the liquid crystal display panel 47 to maintain the voltage of the liquid crystal cell Clc. The storage capacitor Cst may be formed between the liquid crystal cell Clc and the previous stage gate line 46, or between the liquid crystal cell Clc and a separate common line.

The timing controller 41 generates a gate control signal GDC to control the gate driver 44, a data control signal DDC to control the data driver 43 and a control signal to control the modulator 42, by use of a vertical/horizontal synchronization signal V, H and a pixel clock CLK. The timing controller 41 samples digital video data RGB in accordance with the pixel clock CLK and supplies the data RGB to the modulator 42 as the source data SRGB, and in addition, supplies the modulated data MRGB from the modulator 42 to the data driver 43.

The modulator 42 compares the previous frame data with the current frame data after compressing and restoring the data, as a comparison result, it modulates the source data RGB from the timing controller 41 by use of the modulated data MRGB set with the condition of Mathematical Formulas 3 to 5, and supplies the modulated data MRGB to the timing controller 41. The modulated data MRGB is stored at a memory within the lookup table, e.g., in an electrically erasable and programmable ROM (EEPROM).

$$Fn(RGB)<Fn-1(RGB)\text{--->}Fn(MRGB)<Fn(RGB) \quad \text{[MATHEMATICAL FORMULA 3]}$$

$$Fn(RGB)=Fn-1(RGB)\text{--->}Fn(MRGB)=Fn(RGB) \quad \text{[MATHEMATICAL FORMULA 4]}$$

$$Fn(RGB)>Fn-1(RGB)\text{--->}Fn(MRGB)>Fn(RGB) \quad \text{[MATHEMATICAL FORMULA 5]}$$

As shown in the Mathematical Formulas 3 to 5, the modulated MRGB is bigger than the source data of the current frame Fn if the data value of a pixel becomes bigger in the current frame Fn than in the previous frame (Fn−1) in the same pixel, and it is smaller than the source data of the current frame Fn if the data value of the pixel becomes smaller in the current frame Fn than in the previous frame (Fn−1). The modulated data MRGB has the same value as the source data of the current frame Fn if the pixel data value is the same in the current frame Fn as in the previous frame (Fn−1).

The timing controller may be integrated with the modulator 42 into one chip.

The data driver 43 includes a shift register; a register to temporarily store the modulated data MRGB from the timing controller 41; a latch to store the modulate data MRGB of the line and to simultaneously output the stored modulated data MRGB of one line in response to the clock signal from the shift register; a digital/analog converter to select an analog positive/negative gamma compensation voltage in correspondence to the modulated data MRGB value from the latch; a multiplexer to select a data line 45 to which the positive/negative gamma compensation voltage is supplied; and an output buffer connected between the multiplexer and the data line 45. The data driver 43 receives the modulated data MRGB and supplies the modulated data MRGB to the data lines 45 of the liquid crystal display panel 47 under the control of the timing controller 41.

The gate driver 44 includes a shift register to sequentially generate a scan pulse in response to a gate control signal GDC from the timing controller 41, a level shifter to shift the swing width of the scan pulse to an adequate level for driving the liquid crystal cell Clc, and an output buffer. The gate driver 44 supplies the scan pulse to the gate line 46 to turn on the TFTs connected to the gate line 46, thereby selecting the liquid crystal cells Clc of one horizontal line to which the pixel voltage of the data, i.e., the analog gamma compensation voltage, is to be supplied. The data generated from the data driver 43 are synchronized with the scan pulse, thereby being supplied to the liquid crystal cells Clc of a selected one horizontal line.

Figure 5:
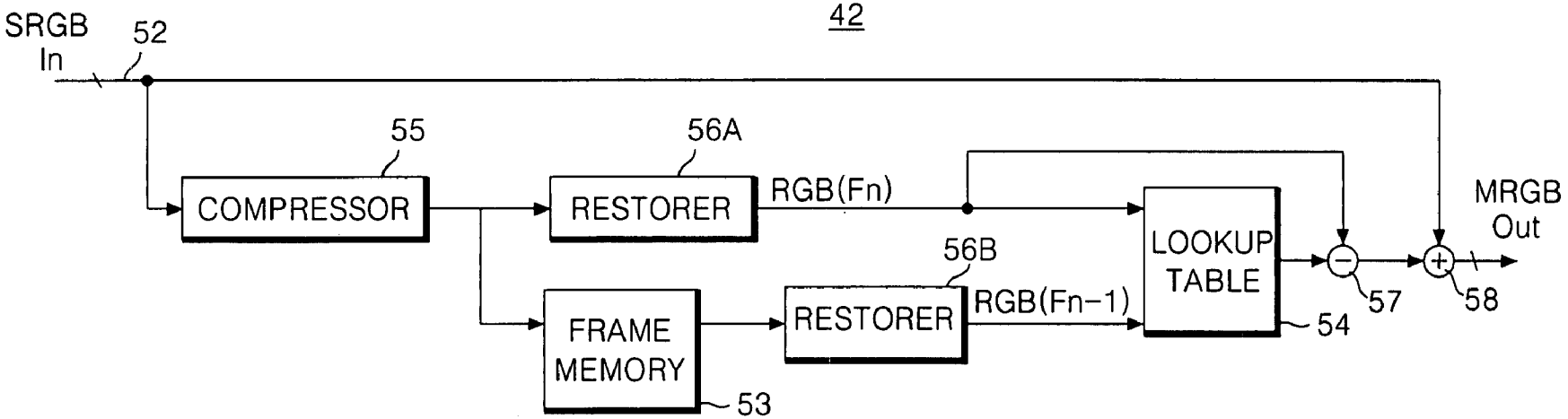
FIG. 5 is a diagram representing a first embodiment of a modulator shown in FIG. 4.

FIG. 5 is a first embodiment of the data modulator 42.

Referring to FIG. 5, the modulator 42 according to the present invention includes a compressor 55, a frame memory 53, first and second restorers 56A, 56B, a lookup table 54, a subtracter 57 and an adder 58.

The compressor 55 compresses the source data inputted from the timing controller 41 through a data bus 52. The compression method used in the compressor 55 can be any known compression method.

The frame memory 53 stores the data compressed by the compressor 55 for one frame period, and then it supplies the compressed data to the second restorer 56B. That is, the frame memory 53 delays the compressed data by one frame period.

If the compression ratio of the data is more than twofold, the compressed data is stored at the frame memory, thus the reading/writing speed (or rate) of the frame memory increases by more than twofold. Accordingly, the reading/writing can be performed for one frame period with one frame memory 53.

The first restorer 56A restores the compressed data of the current frame inputted from the compressor 55 and supplies the restored data to the lookup table 54.

The second restorer 56B restores the compressed data of the previous frame which was read from the frame memory 55 and supplies the restored data to the lookup table 54.

If only the data stored at the frame memory is compressed/restored, an error may be generated due to compression loss between the current frame data which is not compressed/restored and the previous frame data. To prevent this, the driving method and apparatus of the liquid crystal display device according to the present invention compresses all the data of the previous frame and the current frame with the same compression/restoration algorithm, and then it restores each of the compressed data to minimize the error between the current frame data and the previous frame data.

The lookup table 54 compares the previous frame data RGB(Fn−1) with the current frame data RGB(Fn), which are both restored through the same compression/restoration algorithm, and it selects the modulated data pre-set with the condition of mathematical formulas 3 to 5, e.g., the modulated data of table 1, in accordance with the comparison result.

The subtracter 57 subtracts the modulated data selected by the lookup table 54 from the current frame data RGB(Fn), which is from the restorer 56A, and as a result, it outputs the pure modulated portion of the data. If the current frame data is "40", the previous frame data is "30", and the modulated data, which satisfies the condition of mathematical formula 5 as a comparison result of the data, is "45", then the output of the lookup table 54 is "45", the subtracter 57 outputs the difference value between the current frame data and the modulated data, i.e., "5" the pure modulated portion.

On the other hand, if the modulated data within the lookup table is set to be the pure modulated portion, then the subtracter 57 is not required. Accordingly, if the pure modulated portion within the lookup table is "5", e.g., the modulated data selected in the lookup table is "5" when the current frame data is "40" and the previous frame data is "30", the subtracter 57 may be removed.

The adder 58 adds the source data SRGB from the timing controller 41 through the data bus 52 with the modulated portion of the data from the subtracter 57 and the lookup table 54 to supply the added modulated data MRGB to the data driver 43.

Figure 6:
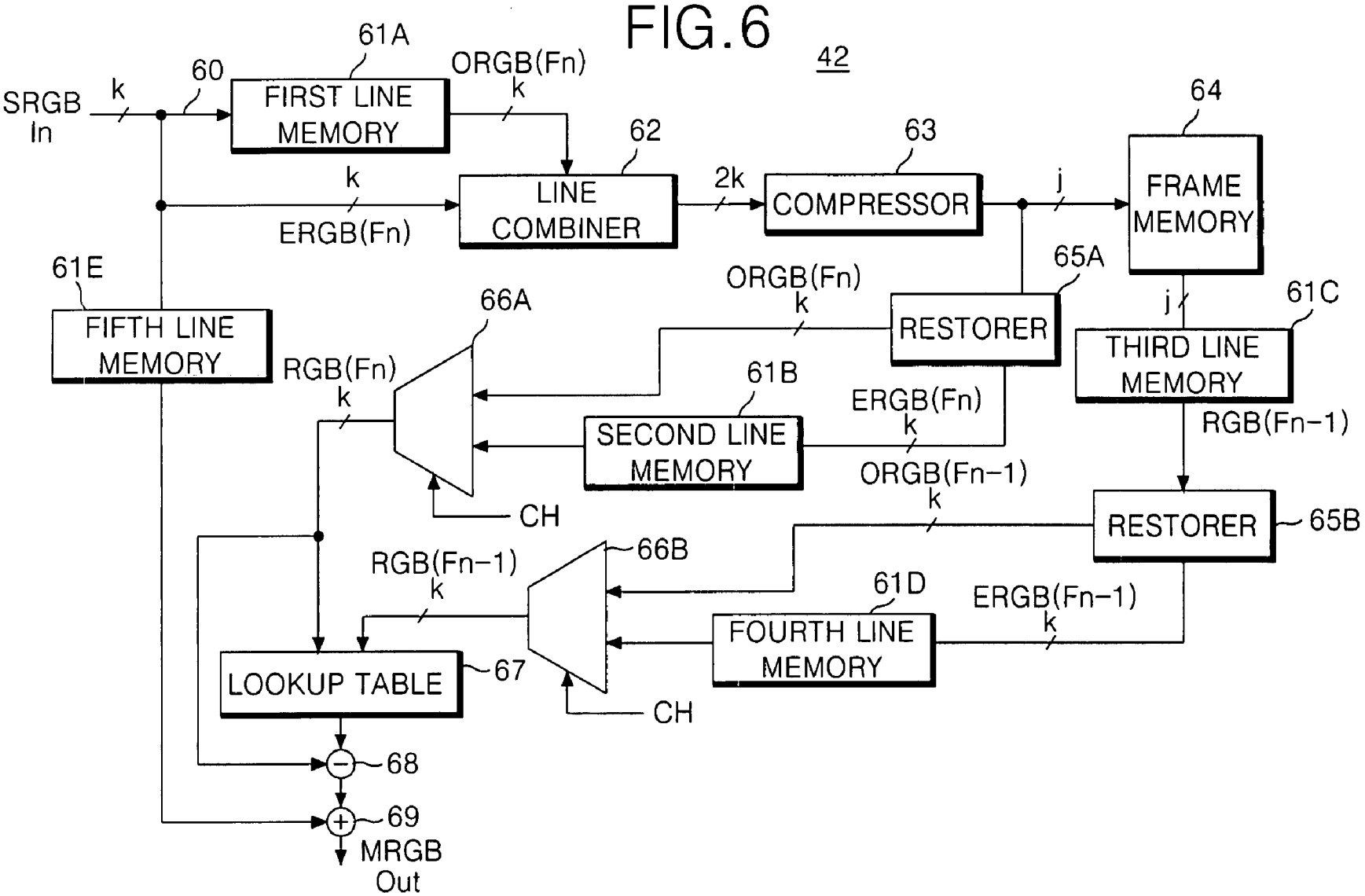
FIG. 6 is a diagram representing a second embodiment of the modulation shown in FIG. 4.

FIG. 6 represents a modulator 42 according to a second embodiment of the present invention in which the modulator 42 simultaneously compresses and restores two lines.

Referring to FIG. 6, the modulator 42 according to the present invention includes first to fifth line memories 61A to 61E, a line combiner 62, a compressor 63, a frame memory 64, first and second restorers 65A, 65B, first and second multiplexers 66A, 66B, a lookup table 67, a subtracter 68 and an adder 69.

The first line memory 61 delays the digital video data RGB of k bits supplied through the data input bus 60 of k bits to supply the delayed digital video data to the line combiner 62.

The line combiner 62 combines the odd numbered data ORGB(Fn) from the first line memory 61 with the even numbered data ERGB(Fn) from the data input bus 60 pixel to pixel to simultaneously output two data lines of one odd line data ORGB(Fn) and the next even line data ERGB(Fn) through the data output bus of 2k bits for an even line period.

The compressor 63 compresses two line data of 2k bits supplied from the line combiner 62 to j, which is smaller than k, bits to supply the compressed data to the frame memory 64 and the second restorer 65B.

The frame memory 64 has a data input bit of j bits and a data output bus of j bits. In the frame memory 64, the two line compressed data, which are compressed by the compressor 63, are written through the data input bus of j bits every even line period. The frame memory 64 supplies the two line compressed data RGB(Fn−1) of the previous frame, which are stored through the data output bus of j bits, to the third line memory 61C every odd line period. If the frame memory 64 is a synchronous dynamic random access memory SDRAM, j is 32.

The first restorer 65A restores two line compressed data RGB(Fn) supplied from the compressor 63 and supplies the even line restored data ERGB(Fn) of the current frame to the second line memory 61B through a first data output bus of kbits. And the first restorer 65A supplies the odd line restored data ORGB(Fn) of the current frame to the first multiplexer 66A through a second data output bus of k bits.

The second line memory 61B supplies the even line restored data ERGB(Fn) of the current frame supplied from the first restorer 65A to the first multiplexer 66A after delaying it for one line period.

The first multiplexer 66A selects the odd line restored data ORGB(Fn) of the current frame supplied from the first restorer 65A every odd line period and selects the even line restored data ERGB(Fn) of the current frame supplied from the second line memory 61B every even line period in response to a control signal from the timing controller 41. That is, the first multiplexer 66A supplies the odd line restored data ORGB(Fn) of the current frame to the lookup table 67 in the odd line period and then it supplies the even line restored data ERGB(Fn) of the current frame to the lookup table 67 in the even line period in response to the control signal CH from the timing controller 41.

The third line memory 61C delays two line compressed data RGB(Fn−1) of the previous frame supplied from the frame memory 64 for one line period to supply it to the second restorer 65B. The third line memory 61C synchronizes the data inputted to the first restorer 65A with the data inputted to the second restorer 65B.

The second restorer 65B restores two line compressed data RGB(Fn−1) of the previous frame supplied from the third line memory 61C and supplies the even line restored data ERGB (Fn−1) of the previous frame to the fourth line memory 61D through the first data output bus of k bits. The second restorer 65B supplies the odd line restored data ORGB(Fn−1) of the previous frame to the second multiplexer 66B through the second data output bus of k bits.

The fourth line memory 61D delays the even line restored data ERGB(Fn−1) of the previous frame supplied from the second restorer 65B by one line period, and then supplies them to the second multiplexer 66B.

The second multiplexer 66B selects the odd line restored data ORGB(Fn−1) of the previous frame supplied from the second restorer 65B every odd line period and selects the even line restored data ERGB(Fn−1) of the previous frame supplied from the fourth line memory 61D every even line period in response to a control signal from the timing controller 41. That is, the second multiplexer 66B supplies the odd line restored data ORGB (Fn−1) of the previous frame to the lookup table 67 in the odd line period and then it supplies the even line restored data ERGB(Fn−1) of the previous frame to the lookup table 67 in the even line period in response to the control signal CH from the timing controller 41.

The lookup table 67 selects modulated data, which satisfies the mathematical formulas 3 to 5 as a comparison result thereof, by having the current frame data RGB(Fn) from the first multiplexer 67A and the previous frame data RGB(Fn−1) from the second multiplexer 67B as their address.

The subtracter 68 subtracts the modulated data selected by the lookup table 67 from the current frame data RGB(Fn), which is from the first multiplexer 66A, and as a result, it outputs the pure modulated portion of the data. If the modulated data within the lookup table is set as the pure modulated portion, then the subtracter 68 may be removed.

The adder 69 adds the source data SRGB from the fifth line memory 61E with the modulated portion of the data from the subtracter 68 or the lookup table 67 to supply the added modulated data MRGB to the data driver 43.

The fifth line memory 61E delays the source data SRGB supplied from the data input bus 60 by one line period and then supplies the delayed data to the adder 69. The fifth line memory 61E synchronizes the source data with the modulated data inputted to the adder 69.

The data compression method by the compressor 63 and the data restoration method by the restorers 65A, 65B can be applied to any known data compression/restoration algorithm.

Figure 7:
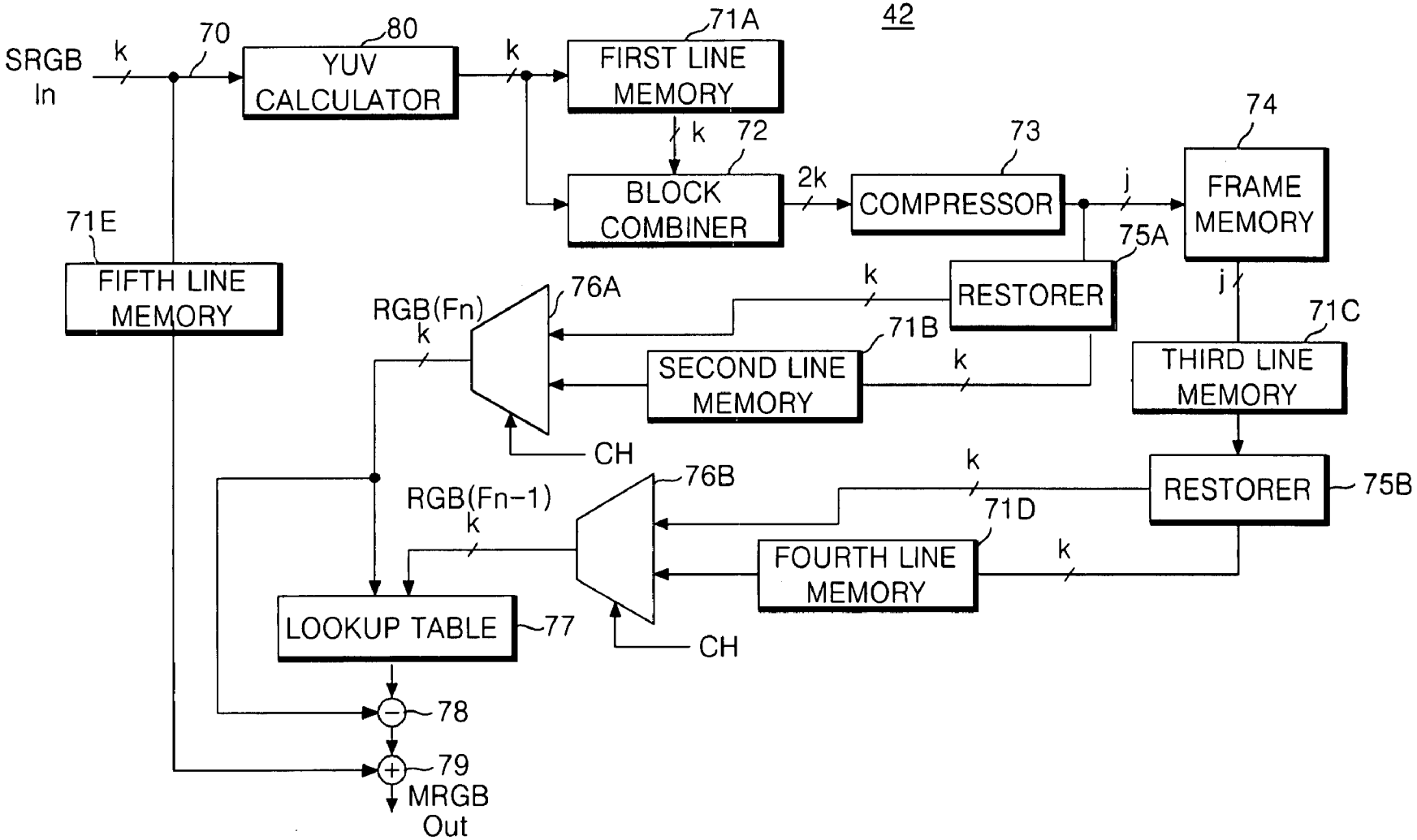
FIG. 7 is a diagram representing a third embodiment of the modulation shown in FIG. 4.

FIG. 7 represents a modulator 42 according to a third embodiment of the present invention, wherein the modulator 42 compresses and restores by the block, which includes a plurality of pixel data, by use of block truncation coding BTC.

Referring to FIG. 7, the modulator 42 according to the present invention includes a YUV calculator 80, line memories 71A to 71E, a block combiner 72, a compressor 73, a frame memory 74, restorers 75A, 75B, multiplexers 76A, 76B, a lookup table 77, a subtracter 78 and an adder 79.

The YUV calculator 80 calculates brightness information Y and chromaticity information U, V using the following mathematical formulas 6 to 8 and digital video data RGB of k bits supplied through a data input bus 70 of k bits, and supplies the brightness and chromaticity information YUV to the first line memory 71A.

$$Y=0.229R+0.587G+0.114B \quad \text{[MATHEMATICAL FORMULA 6]}$$

$$U=-0.147R-0.289G+0.436B=0.492(B-Y) \quad \text{[MATHEMATICAL FORMULA 7]}$$

$$V=0.615R-0.515G-0.100B=0.877(R-Y) \quad \text{[MATHEMATICAL FORMULA 8]}$$

In the mathematical formulas 6 to 8, R is a red data value, G is a green data value, and B is a blue data value.

The first line memory 71A delays the brightness/chromaticity data YUV from the YUV calculator 80 by one line period, and then it supplies them to the block combiner 72.

The block combiner 72 combines the odd line brightness/chromaticity data YUV from the first line memory 71A with the even line brightness/chromaticity data YUV from the YUV calculator 80 into a 4×2 block, which includes eight pixel data, i.e., eight byte data, as shown in FIG. 8, and then it outputs the 4×2 data block for the even line period.

The compressor 73 calculates the mean value and variance value for each of the brightness Y and the chromaticity U,V from the 4×2 data block of the current frame supplied from the block combiner 72, and then it substitutes the pixel data which is more than the mean value with '1' and the pixel data which is less than the mean value with '0' to compress them. This is explained in detail in conjunction with the example of FIG. 9. In the example of FIG. 8, if the pixel data which is more than the mean value is 'A', and the pixel data which is less than the mean value is 'B', then the value of 'A' is as in the mathematical formula 9 and the value of 'B' is as in the Mathematical Formula 10.

$$A = f_M + \sqrt{f_V \frac{N-L}{L}} \quad \text{[MATHEMATICAL FORMULA 9]}$$

$$B = f_M - \sqrt{f_V \frac{L}{N-L}} \quad \text{[MATHEMATICAL FORMULA 10]}$$

In the Mathematical Formulas 8 and 9, '$f_M$' is the mean value for the eight pixel data included in the 4×2 block, and '$f_V$' is the variance value between the eight pixel data included in the 4×2 block. And, 'L' is the pixel number which is equal to or bigger than '$f_M$'-in the example of FIG. 9, '4' is substituted with 'A'-, and 'N' is a total pixel number-in the example of FIG. 9, it is '8', In the example of FIG. 9, if 'A' is substituted with '1' and 'B' is substituted with '0', it is as shown in FIG. 10. The compressed data of FIG. 10 includes 3 bytes where the A value is 1 byte big, the B value is 1 byte big and the AB division value is 1 byte big. In the example of FIG. 10, the AB division value is '11011000' Accordingly, the 8 byte data of the 4×2 data block as in FIG. 8 are compressed to 3 byte data as shown in FIG. 10 by the compressor 73. Such a compression method is applied to the brightness Y and the chromaticity U,V in the same manner.

The frame memory 74 has a data input bus of j bits, in which j is smaller than k, and a data output bus of j bits. In the frame memory 74, the compressed data, which are compressed by the compressor 73, are written through the data input bus of j bits every even line period. The frame memory 74 supplies the compressed data of the previous frame, which are stored through the data output bus of j bits, to the third line memory 71C every odd line period.

The first restorer 75A restores the data from the compressor 73 by the restoration algorithm corresponding to the compression algorithm of the compressor 73 to restore the brightness/chromaticity data as of FIG. 8, and then it restores the digital video data RGB by use of the following Mathematical Formulas 11 to 13. And, the first restorer 75A supplies the restored even line data of the current frame to the second line memory 71B through the first data output bus of k bits and supplies the even line data of the current frame to the first multiplexer 76A through the second data output bus of k bits.

$$R=Y+1.14V \quad \text{[MATHEMATICAL FORMULA 11]}$$

$$G=Y-0.395U-0.581V \quad \text{[MATHEMATICAL FORMULA 12]}$$

$$B=Y+2.032V \quad \text{[MATHEMATICAL FORMULA 13]}$$

The second line memory 71B supplies the even line restored data of the current frame supplied from the first restorer 75A to the first multiplexer 76A after delaying it for one line period.

The first multiplexer 76A selects the odd line restored data of the current frame supplied from the first restorer 75A every odd line period and selects the even line restored data of the current frame supplied from the second line memory 71B every even line period in response to a control signal from the timing controller 41. That is, the first multiplexer 76A supplies the odd line restored data of the current frame to the lookup table 77 in the odd line period and then it supplies the even line restored data of the current frame to the lookup table 77 in the even line period in response to the control signal CH from the timing controller 41.

The third line memory 71C delays the compressed data of the previous frame supplied from the frame memory 74 for one line period to supply it to the second restorer 75B.

The second restorer 75B restores the data from the third line memory 71C by the restoration algorithm corresponding to the compression algorithm of the compressor 73 to restore the brightness/chromaticity data of FIG. 8, and then it restores the digital video data RGB by use of the Mathematical Formulas 11 to 13. The second restorer 75B supplies the restored even line data of the previous frame to the fourth line memory 71D through the first data output bus of k bits and supplies the odd line data of the previous frame to the second multiplexer 76D through the second data output bus of k bits.

The fourth line memory 71D delays the even line restored data of the previous frame supplied from the second restorer 75B by one line period, and then supplies them to the second multiplexer 76B.

The second multiplexer 76B selects the odd line restored data of the previous frame supplied from the second restorer 75B every odd line period and selects the even line restored data of the previous frame supplied from the fourth line memory 71D every even line period in response to a control signal from the timing controller 41. That is, the second multiplexer 76B supplies the odd line restored data of the previous frame to the lookup table 77 in the odd line period and then it supplies the even line restored data of the previous frame to the lookup table 77 in the even line period in response to the control signal CH from the timing controller 41.

The lookup table 77 selects modulated data, which satisfies the mathematical formulas 3 to 5 as a comparison result thereof, by comparing the current frame data RGB(Fn) from the first multiplexer 76A with the previous frame data RGB (Fn−1) from the second multiplexer 76B.

The subtracter 78 subtracts the modulated data selected by the lookup table 77 from the current frame data RGB(Fn), which is from the first multiplexer 76A, and as a result, it outputs the pure modulated portion of the data. If the modulated data within the lookup table is set as the pure modulated portion, then the subtracter 78 may be removed.

The adder 79 adds the source data SRGB from the fifth line memory 71E with the modulated portion of the data from the subtracter 78 or the lookup table 77 to supply the added modulated data MRGB to the data driver 43.

The fifth line memory 71E delays the source data SRGB supplied from the data input bus 60 by one line period and then supplies the delayed data to the adder 79.

On the other hand, the driving method and apparatus of the liquid crystal display device according to the present invention may modulate only most significant bits MSB in the digital video data. In this case, the memory capacity of the lookup table and the frame memories 64, 74 may be further reduced.

As described above, the driving method and apparatus of the liquid crystal display device according to the present invention compresses the data, stores them at the frame memory, and then restores the data which are read from the frame memory. As a result, the driving method and apparatus of the liquid crystal display device may increase the response speed of the liquid crystal through the modulation of the data to increase the display quality and reduce the circuit cost by decreasing the number and the capacity of the frame memories.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus of a display device, the driving apparatus comprising:

a first line memory to delay a first line data of the current frame data by one line period; and a combiner to combine the delayed first line data with un-delayed second line data and to output the combined data;

a compressor to compress the combined data of the current frame from the combiner;

a frame memory to store and delay the compressed current frame data and output as the compressed data of a previous frame;

a first restorer to restore the compressed data of the current frame from the compressor;

a second line memory to delay data from the first restorer;

a first multiplexer to alternately output un-delayed data from the first restorer and delayed data from the second line memory;

a third line memory to delay the compressed data of the previous frame from the frame memory;

a second restorer to restore the compressed data of the previous frame from the third line memory;

a fourth line memory to delay data from the second restorer;

a second multiplexer to alternately output un-delayed data from the second restorer and delayed data from the fourth line memory;

a modulated portion determiner to compare the previous frame from the second multiplexer with the current frame data from the first multiplexer and to determine a modulated portion for the current frame in accordance with the comparison result;

a fifth line memory to delay un-compressed data of the current frame; and a modulator to modulate the current frame data by adjusting the current frame data from the fifth line memory using the modulated portion.

2. The driving apparatus according to claim 1, wherein the modulated portion determiner comprises:

a lookup table to compare the previous frame data with the current frame data and to select pre-set modulated data in accordance with the comparison result; and a subtracter to extract the modulated portion by subtracting the modulated data from the current frame data, wherein the modulator adds data from the fifth line memory with data from the subtracter.

3. The driving apparatus according to claim 1, wherein the modulated portion determiner comprises a lookup table to compare the previous frame data with the current frame data and to select a pre-set modulated portion in accordance with the comparison result, wherein the modulator adds data from the fifth line memory with data from the lookup table.

4. The driving apparatus according to claim 1, wherein only a single frame memory is present within the driving apparatus.

5. The driving apparatus according to claim 1, wherein the first line data is delayed prior to compression of the current frame data by the compressor and the second line data is delayed after restoration of the compressed data by the first and second restorers.

6. The driving apparatus according to claim 1, further comprising:

a brightness and chrominance calculator for calculating brightness and chrominance information for each pixel data from the current frame data and outputting the brightness and chrominance information to the first line memory, wherein the combiner makes a plurality of blocks from the first and second lines data including the brightness and chrominance information and output the blocks to the compressor.

* * * * *

UNITED STATES PATENT AND TRADEMARK OFFICE

CERTIFICATE OF CORRECTION

PATENT NO. : 7,580,019 B2
APPLICATION NO. : 11/150542
DATED : August 25, 2009
INVENTOR(S) : Hee Jung Hong et al.

It is certified that error appears in the above-identified patent and that said Letters Patent is hereby corrected as shown below:

Title Page, (*) Notice: Subject to any disclaimer, the term of this patent is extended or adjusted under 35 U.S.C. 154(b) by 839 days.

should read (*) Notice: Subject to any disclaimer, the term of this patent is extended or adjusted under 35 U.S.C. 154(b) by 1,084 days.

Signed and Sealed this

Twentieth Day of April, 2010

David J. Kappos

David J. Kappos
*Director of the United States Patent and Trademark Office*